US009790716B2

(12) United States Patent
Hagemeyer et al.

(10) Patent No.: US 9,790,716 B2
(45) Date of Patent: Oct. 17, 2017

(54) OPPOSED HOOK SLIDING DOOR LOCK

(71) Applicant: Amesbury Group, Inc., Amesbury, MA (US)

(72) Inventors: Bruce Hagemeyer, Pella, IA (US); Dan Raap, Hartford, SD (US); Gary E. Tagtow, Sioux Falls, SD (US)

(73) Assignee: Amesbury Group, Inc., Amesbury, MA (US)

( * ) Notice: Subject to any disclaimer, the term of this patent is extended or adjusted under 35 U.S.C. 154(b) by 0 days.

(21) Appl. No.: 14/885,366

(22) Filed: Oct. 16, 2015

(65) Prior Publication Data

US 2016/0108650 A1 Apr. 21, 2016

Related U.S. Application Data

(60) Provisional application No. 62/064,859, filed on Oct. 16, 2014.

(51) Int. Cl.
*E05B 65/08* (2006.01)
*E05C 9/00* (2006.01)
(Continued)

(52) U.S. Cl.
CPC ..... *E05C 9/00* (2013.01); *E05B 65/0858* (2013.01); *E05B 81/04* (2013.01); *E05B 81/54* (2013.01);
(Continued)

(58) Field of Classification Search
CPC . E05C 3/002; E05C 3/34; E05C 3/124; E05C 9/00; E05B 65/0858; E05B 81/04; E05B 81/54
(Continued)

(56) References Cited

U.S. PATENT DOCUMENTS 419,384 A 1/1890 Towne
651,947 A 6/1900 Johnson
(Continued)

FOREIGN PATENT DOCUMENTS

AT 84928 12/1920
DE 1002656 2/1957
(Continued)

OTHER PUBLICATIONS

"Intercity Locks—for All Your Security Needs—Fast", http://www.directlocks.co.uk/locks-multipoint-locks-c-123_96.html, accessed Oct. 27, 2011, original publication date unknown, 3 pgs.
(Continued)

*Primary Examiner* — James O Hansen

(57) ABSTRACT

A sliding door lock system has a centrally-disposed operator. The operator has a casing with a trigger retractably extended from the casing. An operator mechanism disposed in the casing is operatively engaged with the trigger. A lock remotely disposed from the operator has a housing. A pair of opposed locking hooks extend from the housing and a spring biases each hook into an unlocked position. A block pivotably connected to the housing is configured to engage the hooks when the hooks are in a locked position. An elongate member operably connects the operator mechanism to the block.

11 Claims, 8 Drawing Sheets

(51) Int. Cl.

| | |
|---|---|
| ***E05B 81/04*** | (2014.01) |
| ***E05B 81/54*** | (2014.01) |
| ***E05C 3/00*** | (2006.01) |
| ***E05C 3/12*** | (2006.01) |
| ***E05C 3/34*** | (2006.01) |
| *E05B 17/20* | (2006.01) |
| *E05B 47/00* | (2006.01) |
| *E05B 63/18* | (2006.01) |
| *E05C 9/04* | (2006.01) |
| *E05C 19/02* | (2006.01) |

(52) U.S. Cl.
CPC ..... *E05C 3/002* (2013.01); *E05C 3/124* (2013.01); *E05C 3/34* (2013.01); *E05B 17/2026* (2013.01); *E05B 47/0012* (2013.01); *E05B 63/185* (2013.01); *E05C 9/041* (2013.01); *E05C 19/026* (2013.01)

(58) Field of Classification Search
USPC ..... 292/44, 45, 49, 50, 54, 194, 197
See application file for complete search history.

(56) References Cited

U.S. PATENT DOCUMENTS 738,280 A 9/1903 Bell et al.
972,769 A 10/1910 Lark
1,094,143 A 4/1914 Hagstrom
1,142,463 A 6/1915 Sheperd
1,251,467 A 1/1918 Blixt et al.
1,277,174 A 8/1918 Bakst
1,359,347 A 11/1920 Fleisher
1,366,909 A 2/1921 Frommer
1,574,023 A * 2/1926 Crompton ..... E05C 3/34 292/24
1,596,992 A 8/1926 Ognowicz
1,646,674 A 10/1927 Angelillo
1,666,654 A 4/1928 Hiering
1,716,113 A 6/1929 Carlson
2,535,947 A 12/1950 Newell
2,739,002 A 3/1956 Johnson
2,862,750 A 12/1958 Minke
3,064,462 A 11/1962 Ng et al.
3,162,472 A 12/1964 Rust
3,250,100 A 5/1966 Cornaro
3,332,182 A 7/1967 Mark
3,413,025 A 11/1968 Sperry
3,437,364 A 4/1969 Walters
RE26,677 E 10/1969 Russell et al.
3,586,360 A 6/1971 Perrotta
3,806,171 A 4/1974 Fernandez
3,899,201 A 8/1975 Paioletti
3,904,229 A 9/1975 Waldo
3,953,061 A 4/1976 Hansen et al.
4,076,289 A 2/1978 Fellows et al.
4,116,479 A 9/1978 Poe
4,132,438 A 1/1979 Guymer
4,236,396 A 12/1980 Surko et al.
4,288,944 A 9/1981 Donovan
4,476,700 A 10/1984 King
4,500,122 A 2/1985 Douglas
4,593,542 A 6/1986 Rotondi et al.
4,602,812 A 7/1986 Bourner
4,607,510 A 8/1986 Shanaan et al.
4,643,005 A 2/1987 Logas
4,691,543 A 9/1987 Watts
4,754,624 A 7/1988 Fleming et al.
4,949,563 A 8/1990 Gerard et al.
4,961,602 A 10/1990 Pettersson
4,962,653 A 10/1990 Kaup
4,962,800 A 10/1990 Owiriwo
4,964,660 A 10/1990 Prevot et al.
4,973,091 A 11/1990 Paulson
5,077,992 A 1/1992 Su
5,092,144 A 3/1992 Fleming et al.
5,118,151 A 6/1992 Nicholas, Jr. et al.
5,125,703 A 6/1992 Clancy et al.
5,171,050 A 12/1992 Mascotte
5,172,944 A 12/1992 Munich et al.
5,193,861 A * 3/1993 Juga ..... E05C 3/34 292/207
5,197,771 A 3/1993 Kaup et al.
5,265,452 A 11/1993 Dawson et al.
5,290,077 A 3/1994 Fleming
5,373,716 A 12/1994 MacNeil et al.
5,382,060 A 1/1995 O'Toole et al.
5,388,875 A 2/1995 Fleming
5,404,737 A 4/1995 Hotzl
5,482,334 A 1/1996 Hotzl
5,495,731 A 3/1996 Riznik
5,513,505 A 5/1996 Danes
5,516,160 A 5/1996 Kajuch
5,524,941 A 6/1996 Fleming
5,524,942 A 6/1996 Fleming
5,544,924 A * 8/1996 Paster ..... E05B 15/0006 160/201
5,609,372 A 3/1997 Ponelle
5,620,216 A 4/1997 Fuller
5,707,090 A 1/1998 Sedley
5,716,154 A 2/1998 Miller et al.
5,722,704 A 3/1998 Chaput et al.
5,782,114 A 7/1998 Zeus et al.
5,791,700 A 8/1998 Biro
5,820,170 A 10/1998 Clancy
5,820,173 A 10/1998 Fuller
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.
5,915,764 A 6/1999 MacDonald
5,951,068 A 9/1999 Strong et al.
6,050,115 A 4/2000 Schroter et al.
6,094,869 A 8/2000 Magoon et al.
D433,916 S 11/2000 Frey
6,148,650 A 11/2000 Kibble
6,174,004 B1 1/2001 Picard et al.
6,196,599 B1 3/2001 D'Hooge
6,209,931 B1 4/2001 Von Stoutenborough et al.
6,217,087 B1 4/2001 Fuller
6,250,842 B1 6/2001 Kruger
6,257,030 B1 7/2001 Davis, III et al.
6,264,252 B1 7/2001 Clancy
6,266,981 B1 7/2001 von Resch et al.
6,282,929 B1 9/2001 Eller et al.
6,283,516 B1 9/2001 Viney
6,293,598 B1 9/2001 Rusiana
6,327,881 B1 12/2001 Grundler et al.
6,389,855 B2 5/2002 Renz et al.
6,443,506 B1 9/2002 Su
6,454,322 B1 9/2002 Su
6,502,435 B2 1/2003 Watts et al.
6,516,641 B1 2/2003 Segawa
6,637,784 B1 10/2003 Hauber et al.
6,672,632 B1 1/2004 Speed et al.
6,688,656 B1 2/2004 Becken
6,733,051 B1 5/2004 Cowper
6,776,441 B2 8/2004 Liu
6,810,699 B2 11/2004 Nagy
6,871,451 B2 3/2005 Harger et al.
6,935,662 B1 8/2005 Hauber et al.
6,971,686 B2 12/2005 Becken
6,994,383 B2 2/2006 Morris
7,025,394 B1 4/2006 Hunt
7,083,206 B1 8/2006 Johnson
7,155,946 B2 1/2007 Lee et al.
7,207,199 B2 4/2007 Smith et al.
7,249,791 B2 7/2007 Johnson
7,261,330 B1 8/2007 Hauber
7,404,306 B2 7/2008 Walls et al.
7,418,845 B2 9/2008 Timothy
7,513,540 B2 4/2009 Hagemeyer et al.

(56) References Cited

U.S. PATENT DOCUMENTS

| | | | |
|---|---|---|---|
| 7,634,928 | B2 | 12/2009 | Hunt |
| 7,677,067 | B2 | 3/2010 | Riznik et al. |
| 7,707,862 | B2 | 5/2010 | Walls et al. |
| 7,726,705 | B2 | 6/2010 | Kim |
| 7,735,882 | B2 | 6/2010 | Abdollahzadeh et al. |
| 7,856,856 | B2 | 12/2010 | Shvartz |
| 7,878,034 | B2 | 2/2011 | Alber et al. |
| 8,182,002 | B2 | 5/2012 | Fleming |
| 8,348,308 | B2 | 1/2013 | Hagemeyer et al. |
| 8,376,414 | B2 | 2/2013 | Nakanishi et al. |
| 8,382,166 | B2 | 2/2013 | Hagemeyer et al. |
| 8,382,168 | B2 * | 2/2013 | Carabalona ..... E05B 47/004 292/216 |
| 8,398,126 | B2 | 3/2013 | Nakanishi et al. |
| 8,628,126 | B2 | 1/2014 | Hagemeyer et al. |
| 8,840,153 | B2 | 9/2014 | Juha |
| 8,850,744 | B2 | 10/2014 | Bauman et al. |
| 8,939,474 | B2 | 1/2015 | Hagemeyer et al. |
| 2002/0104339 | A1 | 8/2002 | Saner |
| 2003/0159478 | A1 | 8/2003 | Nagy |
| 2004/0107746 | A1 | 6/2004 | Chang |
| 2004/0239121 | A1 | 12/2004 | Morris |
| 2005/0103066 | A1 | 5/2005 | Botha et al. |
| 2005/0144848 | A1 | 7/2005 | Harger et al. |
| 2005/0229657 | A1 | 10/2005 | Johansson et al. |
| 2007/0068205 | A1 | 3/2007 | Timothy |
| 2007/0080541 | A1 | 4/2007 | Fleming |
| 2007/0113603 | A1 | 5/2007 | Polster |
| 2007/0170725 | A1 | 7/2007 | Speyer et al. |
| 2007/0259551 | A1 * | 11/2007 | Rebel ..... E05B 63/0056 439/260 |
| 2008/0087052 | A1 | 4/2008 | Abdollahzadeh et al. |
| 2008/0092606 | A1 | 4/2008 | Meekma |
| 2008/0141740 | A1 | 6/2008 | Shvartz |
| 2008/0150300 | A1 | 6/2008 | Harger et al. |
| 2008/0156048 | A1 | 7/2008 | Topfer |
| 2008/0156049 | A1 | 7/2008 | Topfer |
| 2008/0178530 | A1 | 7/2008 | Ellerton et al. |
| 2008/0179893 | A1 | 7/2008 | Johnson |
| 2008/0184749 | A1 | 8/2008 | Alber et al. |
| 2009/0078011 | A1 | 3/2009 | Avni |
| 2010/0154490 | A1 | 6/2010 | Hagemeyer et al. |
| 2010/0213724 | A1 | 8/2010 | Uyeda |
| 2010/0236302 | A1 | 9/2010 | Uyeda |
| 2010/0327610 | A1 | 12/2010 | Nakanishi et al. |
| 2011/0198867 | A1 | 8/2011 | Hagemeyer et al. |
| 2011/0289987 | A1 | 12/2011 | Chiou et al. |
| 2012/0146346 | A1 | 6/2012 | Hagemeyer et al. |
| 2012/0306220 | A1 | 12/2012 | Hagemeyer et al. |
| 2013/0019643 | A1 | 1/2013 | Tagtow et al. |
| 2013/0140833 | A1 | 6/2013 | Hagemeyer et al. |
| 2013/0152647 | A1 | 6/2013 | Terei et al. |
| 2013/0234449 | A1 | 9/2013 | Dery et al. |
| 2014/0060127 | A1 | 3/2014 | Hemmingsen et al. |
| 2014/0125068 | A1 | 5/2014 | Hagemeyer et al. |
| 2014/0159387 | A1 | 6/2014 | Hagemeyer et al. |
| 2016/0369525 | A1 | 12/2016 | Tagtow et al. |

FOREIGN PATENT DOCUMENTS

| | | | |
|---|---|---|---|
| DE | 1584112 | | 9/1969 |
| DE | 2639065 | | 3/1977 |
| DE | 3032086 | | 3/1982 |
| DE | 3836693 | | 5/1990 |
| DE | 9011216 | | 10/1990 |
| DE | 4224909 | | 2/1993 |
| DE | 29807860 | | 8/1998 |
| DE | 10253240 | | 5/2004 |
| DE | 202012002743 | U1 | 4/2012 |
| DE | 202013000920 | U1 | 4/2013 |
| DE | 202013000921 | U1 | 4/2013 |
| DE | 202013001328 | U1 | 5/2013 |
| EP | 0007397 | A1 | 2/1980 |
| EP | 0231042 | A2 | 8/1987 |
| EP | 341173 | | 11/1989 |
| EP | 359284 | | 3/1990 |
| EP | 661409 | | 7/1995 |
| EP | 792987 | | 9/1997 |
| EP | 1106761 | | 6/2001 |
| EP | 1867817 | | 12/2007 |
| EP | 2128362 | | 12/2009 |
| EP | 2273046 | A2 | 1/2011 |
| EP | 2339099 | A1 | 6/2011 |
| EP | 2581531 | A1 | 4/2013 |
| EP | 2584123 | A1 | 4/2013 |
| EP | 2584124 | A2 | 4/2013 |
| FR | 21883 | E | 4/1921 |
| FR | 1142316 | | 3/1957 |
| FR | 1162406 | A | 9/1958 |
| FR | 1201087 | | 12/1959 |
| FR | 2339723 | | 9/1977 |
| FR | 2342390 | | 9/1977 |
| FR | 2344695 | | 10/1977 |
| FR | 2502673 | | 10/1982 |
| GB | 226170 | | 4/1925 |
| GB | 264373 | A | 1/1927 |
| GB | 612094 | A | 11/1948 |
| GB | 1498849 | | 1/1978 |
| GB | 1575900 | | 10/1980 |
| GB | 2051214 | | 1/1981 |
| GB | 2076879 | | 12/1981 |
| GB | 2115055 | A | 9/1983 |
| GB | 2122244 | | 1/1984 |
| GB | 2126644 | | 3/1984 |
| GB | 2134170 | | 8/1984 |
| GB | 2136045 | | 9/1984 |
| GB | 2168747 | | 6/1986 |
| GB | 2196375 | | 4/1988 |
| GB | 2212849 | | 8/1989 |
| GB | 2225052 | | 5/1990 |
| GB | 2230294 | | 10/1990 |
| GB | 2242702 | | 10/1991 |
| GB | 2244512 | | 12/1991 |
| GB | 2265935 | | 10/1993 |
| GB | 2270343 | | 3/1994 |
| GB | 2280474 | | 2/1995 |
| GB | 2318382 | A | 4/1998 |
| GB | 2364545 | | 1/2002 |
| GB | 2496911 | A | 5/2013 |
| IT | 614960 | | 1/1961 |
| SE | 309372 | | 3/1969 |
| WO | 96/25576 | | 8/1996 |
| WO | 02/33202 | | 4/2002 |
| WO | 2007/104499 | | 9/2007 |

OTHER PUBLICATIONS

"Intercity Locks—for All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—for All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.

"LocksOnline.co.uk: Premier Supplier of Security Products", http://www.locksonline.co.uk/acatalog/upvc_Locks.html, accessed Oct. 27, 2011, original publication date unknown, 6 pgs.

"uPVC Window Hardware and uPVC Door Hardware online", http://www.upvc-hardware.co.uk/, accessed Oct. 27, 2011, original publication date unknown, 2 pgs.

PCT International Search Report and Written Opinion in International Application PCT/US2015/055969, mailed Feb. 1, 2016, 17 pgs.

* cited by examiner

OPPOSED HOOK SLIDING DOOR LOCK

CROSS-REFERENCE TO RELATED APPLICATIONS

This application claims priority to and the benefit of U.S. Provisional Application Ser. No. 62/064,859, filed Oct. 16, 2014, the disclosure of which is hereby incorporated by reference herein in its entirety.

Locks are installed on sliding doors to lock the door to the door frame for security purposes. Typically, sliding door locks include one or more locking elements in the form of hooks that may be pivoted into an associated keeper or strike on the door. Typically, these locking elements are disposed within a lock housing when unlocked and extend from the housing when locked. Additionally, the locking elements are disposed proximate a center of the door height. Such placement is generally well-known by intruders, who often concentrate their breaching efforts against the center of the door to defeat the lock. Additionally, single hook sliding door locks can often be defeated by lifting the door from its sliding track and pulling the hook out of the keeper.

SUMMARY

The technology described herein is a high strength, secure sliding door lock with one or more locking points. Each locking mechanism has opposing hooks with a hook block between the hooks for exceptionally high locking strength and security. A single separate lock operator between the individual locks operates the lock system.

In one aspect, the technology relates to a sliding door lock system having: a centrally-disposed operator having: a casing; a trigger retractably extending from the casing; and an operator mechanism disposed in the casing and operatively engaged with the trigger; a lock disposed remote from the operator, the lock having: a housing; a pair of opposed locking hooks extending from the housing; and a spring biasing each of the pair of opposed locking hooks into an unlocked position; and a block pivotably connected to the housing, wherein the block is configured to engage the pair of opposed locking hooks when the pair of opposed locking hooks are in a locked position; and an elongate member operably connecting the operator mechanism to the block. In an embodiment, the pair of opposed locking hooks each includes a contact face configured to contact a strike so as to pivot each of the pair of opposed locking hooks into the locked position. In another embodiment, the lock further includes a block spring configured to bias the block into an engaged position where the block engages the pair of opposed locking hooks while in the locked position. In yet another embodiment, the lock further includes a release lever configured to oppose a force generated by the block spring, so as to hold the block in a disengaged position. In still another embodiment, the elongate mechanism is a tension member configured to be substantially slack when the lock is in the locked position and configured to be substantially taut when the lock is in the unlocked position.

In another embodiment of the above aspect, the operator mechanism includes: at least one rack; and a rotatable element engaged with the rack, wherein a rotation of the rotatable element moves the at least one rack between a first position and a second position. In another embodiment, the operator mechanism further includes a take-up mechanism connecting the at least one rack to the elongate member. In yet another embodiment, the take-up mechanism further includes a spring-controlled linkage.

In another aspect, the technology relates to a lock having: a housing; a pair of opposed locking hooks extending from the housing, wherein the pair of opposed locking hooks each include a contact face configured to contact a strike so as to pivot each of the pair of opposed locking hooks into a locked position; and a spring biasing each of the pair of opposed locking hooks into an unlocked position. In an embodiment, the lock further includes: a block pivotably connected to the housing, wherein the block is configured to engage the pair of opposed locking hooks in the locked position. In another embodiment, the pair of opposed locking hooks each includes a detent for receiving at least a portion of the block. In yet another embodiment, a release lever is configured to pivot so as to move the block from an engaged position to a disengaged position. In still another embodiment, a pivoting movement of the release lever is controlled by an elongate element extending into the housing from an exterior of the housing.

In another embodiment of the above aspect, a pivoting movement of the release lever is controlled by a motor disposed within the housing. In an embodiment, the lock further includes the motor.

In another aspect, the technology relates to a lock system having: a casing; and an operator mechanism disposed in the casing; a first housing disposed remote from the casing; a lock mechanism disposed in the first housing; and a pair of first opposing hooks extending from the first housing in both an unlocked position and a locked position, wherein each of the pair of first opposing hooks each includes a contact face configured to engage a strike so as to pivot each of the pair of first opposing hooks from the unlocked position to the locked position. In an embodiment, the lock system further includes a block configured to releasably engage a detent in each of the pair of first opposing hooks so as to secure the pair of first opposing hooks in the locked position. In another embodiment, the block is movable based on an actuation of the operator mechanism. In yet another embodiment, the lock system further includes a tension element, wherein the actuation of the operator mechanism transfers movement to the block via the tension element. In still another embodiment, the lock system further includes a motor, wherein the actuation of the operator mechanism sends a signal to the motor.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

The design geometry of the proposed dual hooks is significantly different than the geometries normally used for lock mechanisms for sliding doors. For example, current sliding door locks have weak pivoting single-point hooks for locking. The present lock utilizes, in certain examples, stronger dual hooks, larger diameter rivet pins, a robust hook blocking mechanism, and adjustable engaging lock strikes.

The centrally-located lock operator that controls the remote dual hook locks is designed to release the individual locks above and below the lock operator by disengaging a locking block from engagement with the latched hooks. In an example, the operator releases the locks with a spring-loaded mechanism that pulls a tension member to each lock. The spring-loaded mechanism may be configured for over-travel, which simplifies lock installation, adjustment, and release timing. The dual hooks on each lock engage individual frame-mounted strikes when the door is closed, causing them to rotate and wrap around each frame-mounted strike. Lock release adjustments can be adjusted from the edge of the door panel without removing the lock system from the door panel. The lock operator may be controlled by an interior rotating handle or standard thumb turn and key cylinder mounted on typical sliding door hardware. Rotating sliding door handles are described in U.S. Patent Application Publication No. 2013/0334829, the disclosure of which is hereby incorporated by reference herein in its entirety. Alternatively, the lock hooks may be pivoted by a motor that is signaled to operate as described herein.

As the door is unlocked, the rotating handle (or thumb turn or key) turns the operating cam pinion in the lock operator by, in certain embodiments, 70 degrees to the unlocked position. In other embodiments, the cam may rotate by, e.g., 90 degrees to the unlocked position. Other angles of rotation are contemplated. The lock operator pulls taut the tension members between the operator and each lock. As the tension member tightens, the hook block rotates out of position, releasing the hooks and unlocking the door. With the tension members taut and the hook block retracted, the door can be pulled away from the frame such that the dual locks automatically unlatch.

When the door is closed, the trigger release on the lock operator contacts the frame. Additionally, the opposing hooks at each lock contact the frame strikes and pivot so as to wrap around the strike in the locked position. Once in the closed position, the operator cam pinion in the lock operator is rotated so as to lock the door. Rotation may be performed by the rotating handle, thumb turn, or the key. The operation of the various components is described below and depicted in the accompanying figures.

Figure 1:
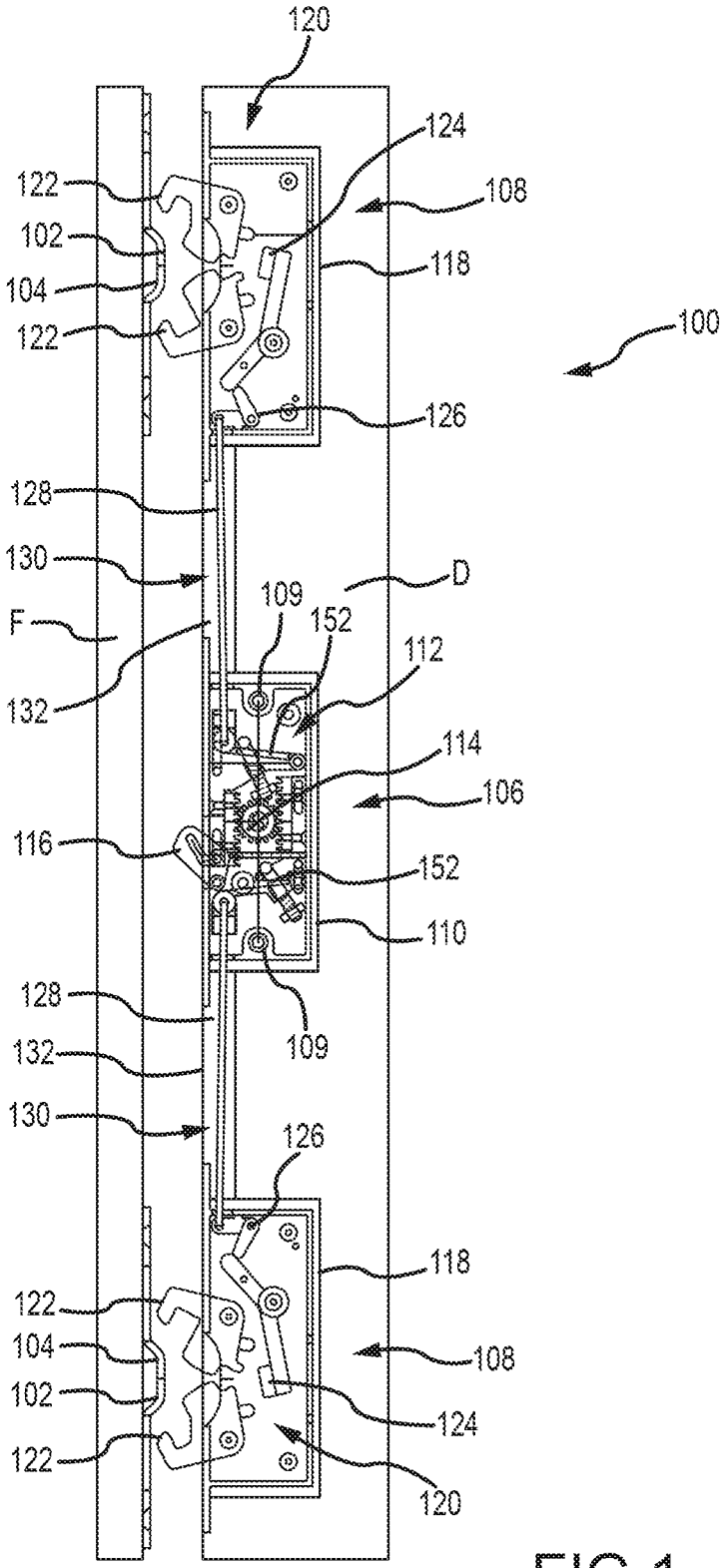
FIG. 1 depicts side sectional view of a door frame, including an opposed hook lock system, in an unlocked configuration.

FIG. 1 depicts side sectional view of a door frame F, including an opposed hook lock system 100, in an unlocked configuration. The lock system 100 is installed in a sliding door D, but in other embodiments, the lock system 100 may be installed in the frame F. A plurality of strikes 102 or keepers are installed on the frame F, but may also be installed on the door D if the lock system 100 is installed on the frame F. The strikes 102 include a raised center 104 that the lock system 100 (specifically, opposed hooks thereof) may grip as described below. The lock system 100 includes a centrally-disposed lock operator 106 and one or more remotely-disposed locks 108. Each of the lock operator 106 and remotely-disposed locks 108 are described in more detail herein. In general, however, the lock operator 106 includes a casing 110 having an operator mechanism (depicted generally as 112) disposed therein. The casing 110 is held together with a plurality of case rivets, several of which acting as pivots or anchors for various components of the operator mechanism 112. One or more elongate members 128 (which in certain examples may be rigid bars or rods) extend from the lock casing 110 at each end and extend to each lock 108. Guides 109 in the casing 110 enable connection to a sliding door handle or escutcheon (not shown). For example, the guides 109 may be through-holes for receiving escutcheon plate set screws. A face plate 111 may define one or more openings for a release trigger 116 to protrude, or to allow access to elements that enable adjustment of the internal elements of the operator mechanism 112.

The operator mechanism 112 is controlled by and includes an operating cam pinion 114. One example of a particular configuration of the operator mechanism 112 is depicted below, which receives input from a rotating handle, thumb turn, or key, as well as the release trigger 116. The operating mechanism 112 moves a spring-loaded take-up mechanism 152 to extend or retract one or more elongate members 128. In examples where the elongate members 128 are tension members (such as cables, wires, or chains), the spring-loaded take-up mechanism 152 may tighten or loosen the tension members 128. The release trigger 116 enables actuation of the operator mechanism 112 (more specifically, actuation of the operating cam pinion 114, as described below). The release trigger 116 projects out of the casing face plate 111. When the door D is closed, the release trigger 116 rotates into a position allowing the rack 148 to extend. If the door D is open, the release trigger 116 restricts the motion of the rack 148, thus preventing rotation of the operating cam pinion 114. The release trigger 116 prevents the operator mechanism 112 from functioning when the door D is open. As such, the release trigger 116 acts as an anti-slam device, preventing the hooks 122 from being actuated into a closed position when the door D is open.

Figure 2:
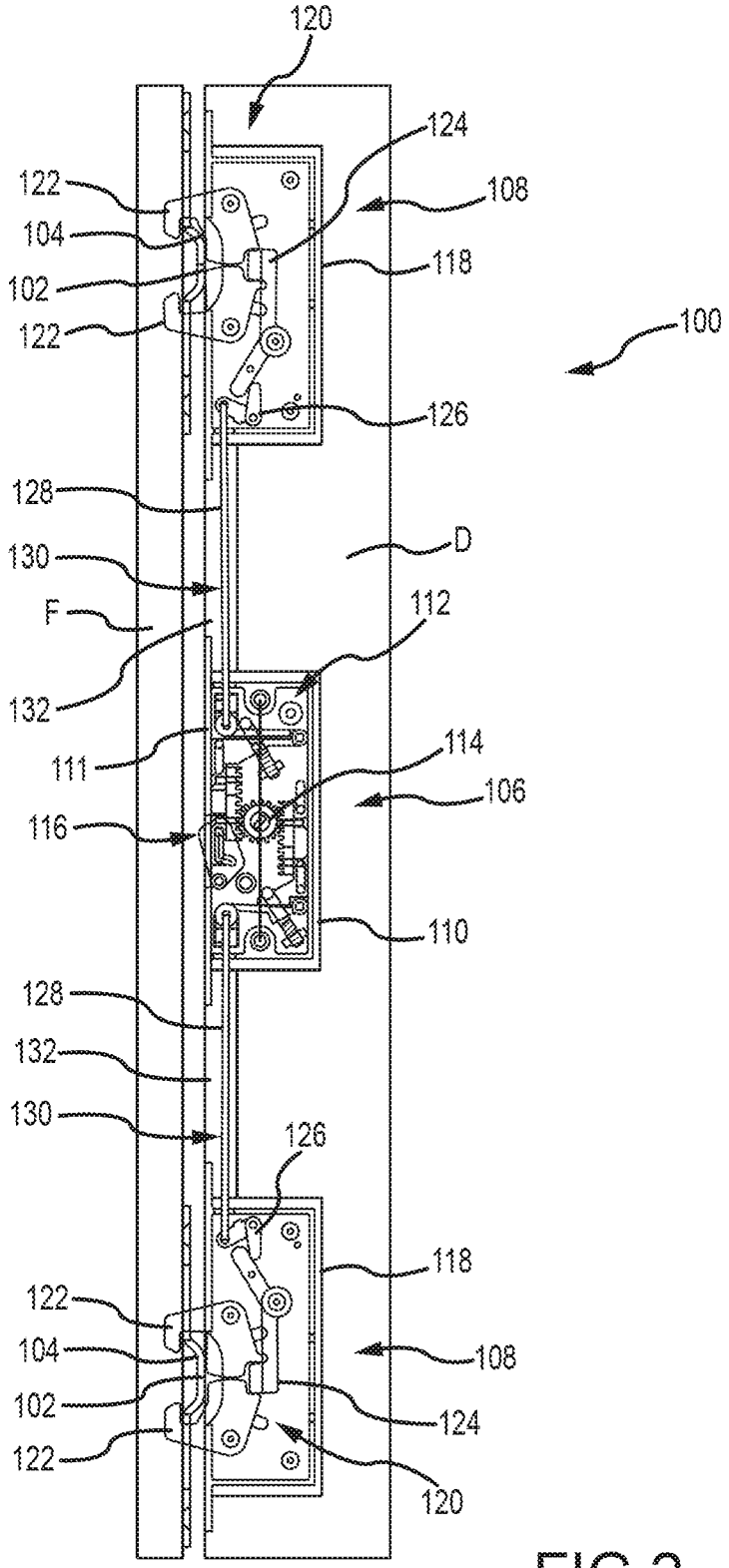
FIG. 2 depicts side sectional view of a door frame, including the opposed hook lock system of FIG. 1, in a locked configuration.
Figure 2A:
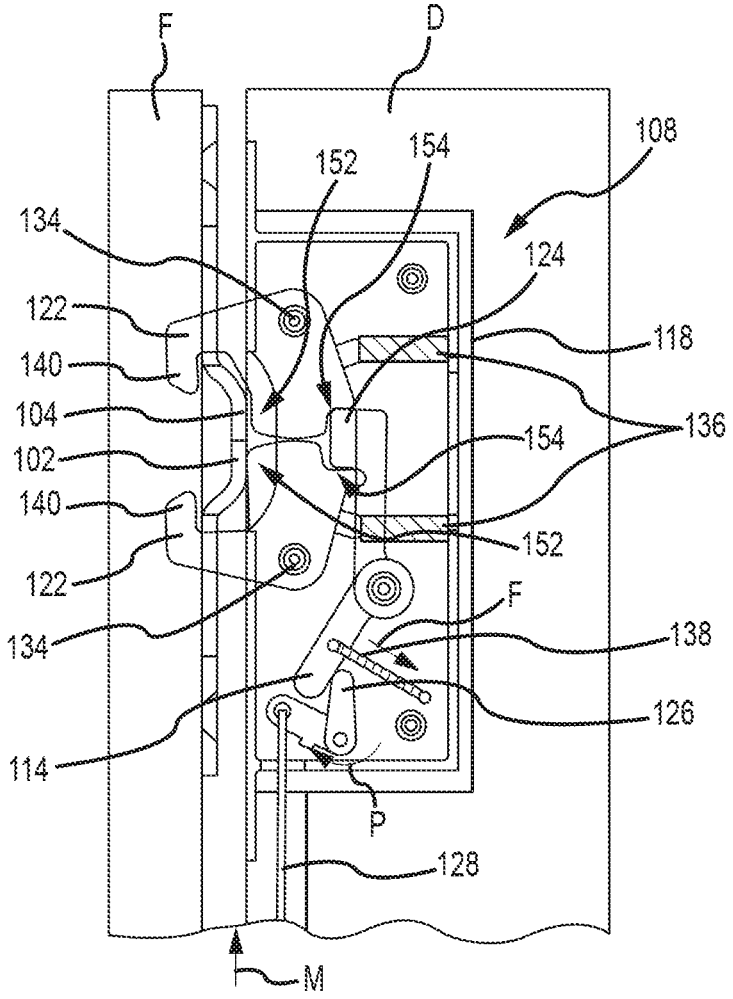
FIG. 2A depicts an enlarged side sectional view of the lock of FIG. 2, in a locked configuration.

One or more locks 108 are disposed remote from the lock operator 106. Each lock 108 includes a housing 118 that contains a lock mechanism (depicted generally as 120). A pair of pivoting hooks 122 project from the housing 118 in both the unlocked and latched/locked positions (as depicted in FIGS. 2 and 2A). The lock mechanism 120 includes a block 124 that is configured to engage the hooks 122 when the hooks 122 are in the latched position. Once so engaged, the lock system 100 is locked. A block release lever 126 is configured to move the block 124 between a disengaged position and an engaged position and is connected to the operator mechanism 112 via an elongate element or member 128, as described below.

In the depicted example, the casing 110 is discrete from the housings 118 and the elongate member 128 is disposed within a slot 130 formed in the door D that may be covered by a face plate 132. This configuration allows the lock system 100 to be field-modified to be fitted into doors D having differing heights. In other examples, the lock system 100 may be disposed in a single housing (that is, the casing 110 and housings 118 may be integrated into a single housing). In such a case, the operator mechanism 112 is still disposed remote from the lock mechanism 120, in that the two mechanisms are connected by elongate members 128.

FIGS. 1A, 1B, 2A, and 2B depict upper locks 108 of the lock system 100. Lower locks 108 are not depicted, but operation thereof would be apparent to a person of skill in the art. In the depicted lock system 100, upper and lower locks 108 are mirror images of each other.

Figure 1A:
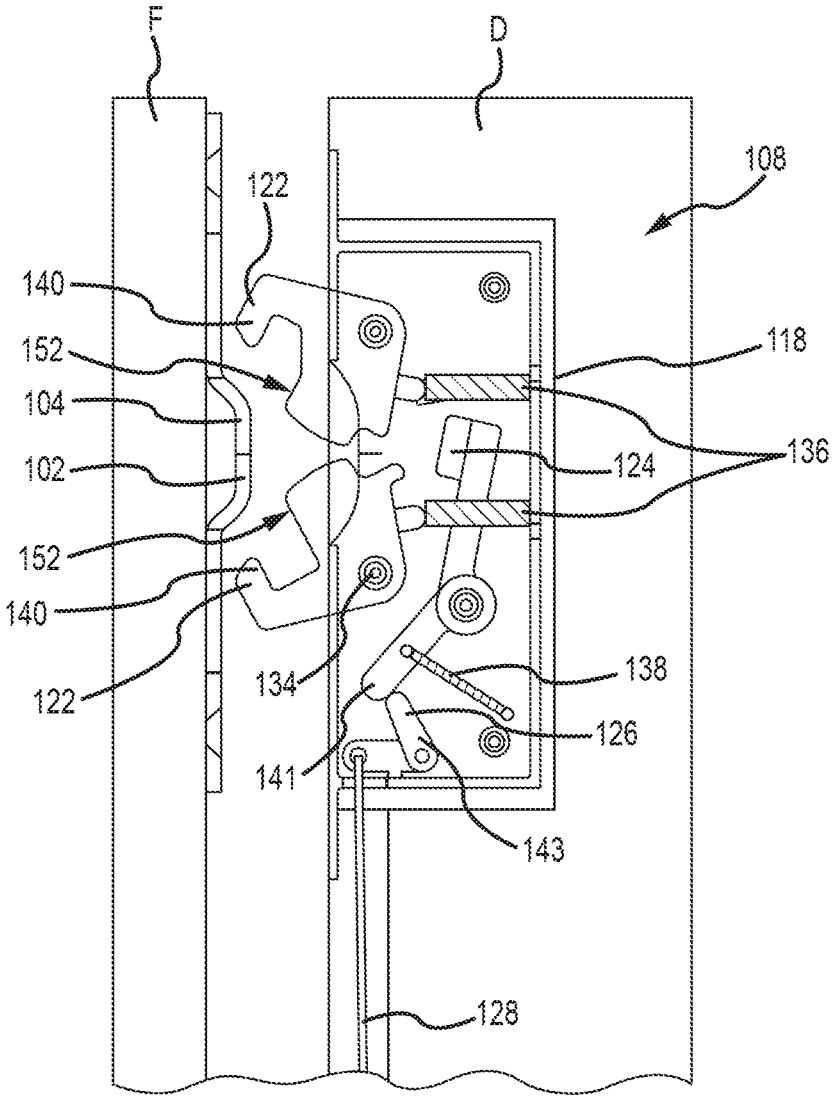
FIG. 1A depicts an enlarged side sectional view of the lock of FIG. 1, in an unlocked configuration.

FIG. 1A depicts an enlarged side sectional view of the lock 108 of FIG. 1, in the unlocked configuration. As described above, the lock housing 118 includes two hooks 122 extending therefrom in both the unlocked position (depicted in FIG. 1A) and the latched/locked position (depicted in FIG. 2A). The hooks 122 are configured to pivot around rivets 134, which are secured to the housing 118 and are biased by compression springs 136 into the unlocked position. In another example, springs 136 may be torsion springs disposed about rivets 134. In the depicted, unlocked configuration, a block spring 138 applies a biasing force F against a block lever 141, movement of which is prevented by a release lever 126 positioned as depicted. Thus, the block 124 remains disengaged from the hooks 122 until actuated. The elongate member 128, such as a tension member, is connected to the release lever 126.

Figure 1B:
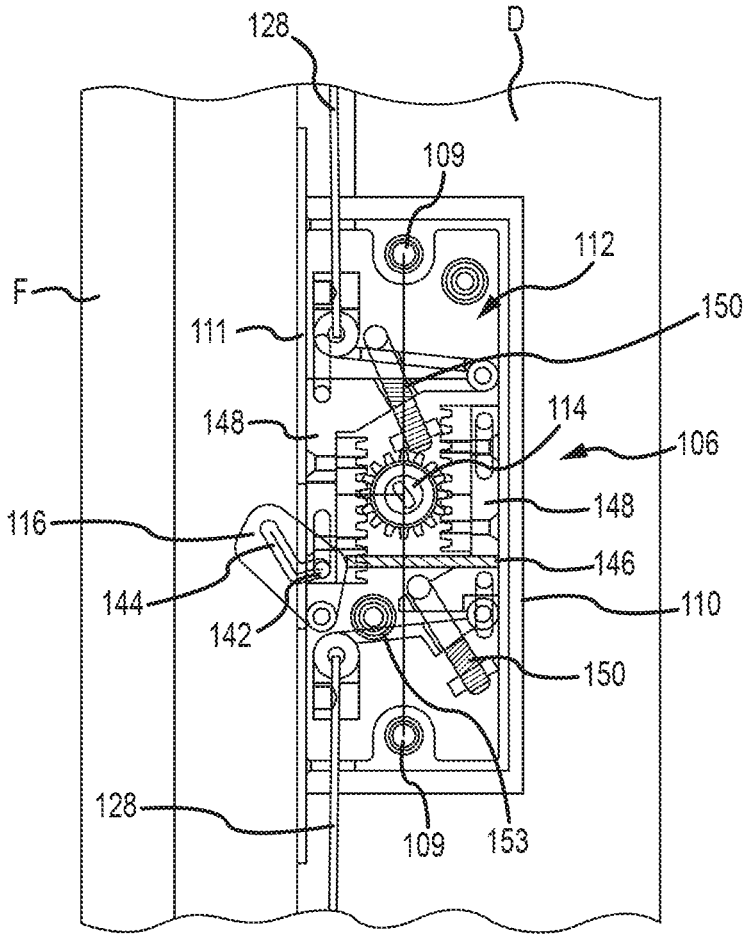
FIG. 1B depicts an enlarged side sectional view of the lock operator of FIG. 1, in a non-activated configuration.

FIG. 1B depicts an enlarged side sectional view of the lock operator 106 of FIG. 1, in a non-activated configuration. Here, the release trigger 116 extends from the lock casing 110. A stop pin 142 is connected to the rack 148. As such, a position of the stop pin 142 in a slot 144 defined by the release trigger 116 prevents actuation of the operating cam pinion 114, which in turn prevents movement of the block 124 (depicted in FIG. 1A). A spring 146 biases the release trigger 116 into the extended position. The operating cam pinion 114 is engaged with two racks 148. The lock mechanism 112 also includes two spring-loaded take-up mechanisms that extend between the racks 148 and the elongate members 128. These take-up mechanisms include a spring-controlled linkage 153 that allows the rack 148 to over-travel when the operating cam pinion 114 is turned (e.g., 70 degrees, 90 degrees, etc.) to unlock and lock the locks 108. A compression spring 150 controls maximum movement of the linkage 153. One or more screws may be utilized to lock the elongate member 128 in place at a point of connection to the take-up mechanism (specifically, to the linkage 153). These screws may also be used to adjust tension of the elongate members 128. In examples, the elongate members 128 that may be substantially taut when the operator mechanism 112 is in the non-activated configuration depicted in FIGS. 1-1B.

FIG. 2 depicts side sectional view of a door frame F, including the opposed hook lock system 100 of FIG. 1, in a locked configuration. A number of components depicted in FIG. 2 are described above with regard to FIGS. 1-1B and as such, are not described further. Here, as the door D is moved towards the frame F, portions of each hook 122 contact the raised center 104 of each strike 102. This contact forces pivoting of the hooks 122 until they are engaged with the strike 102. With the hooks 122 engaged with the strike 102, the door D is passively latched. That is, by contacting the hooks 122 and the strikes 102, the hooks 122 grip the strikes 102, without any active action on the part of the person sliding the door D. As such, pulling the door D away from the frame F will disengage the hooks 122 from the strikes 102. To lock the lock system 100, the blocks 124 must be engaged with the hooks 122, which in certain examples, requires an active action on the part of the user (rotating a handle or thumb turn, for example). Locking of the lock system 100 by engaging the blocks 124 with the hooks 122 is performed as described in more detail below.

FIG. 2A depicts an enlarged side sectional view of the lock 108 of FIG. 2, in the locked configuration. As described above, as the door D is moved towards the frame F, the hooks 122 passively engage the strike 102. The hooks 122 each include leading contact faces or surfaces 152. As these contact faces 152 contact the center portion 104 of the strike 102, the hooks 122 rotate about the rivets 134, in opposition to the forces applied by the compression springs 136, so as latch to the strikes 102. The lock system 100 is not locked until the block 124 is engaged with detents 154 in the hooks 122. To engage the block 124 with the detents 154, the elongate member 128 is moved M, which causes the release lever 126 to pivot, due to the force F generated by the block spring 138. As the release lever 126 pivots P, the block 124 is engaged with the detents 154 so as to lock the lock 108, preventing the door D from being pulled open. Movement of the elongate member 128 is described below.

Figure 2B:
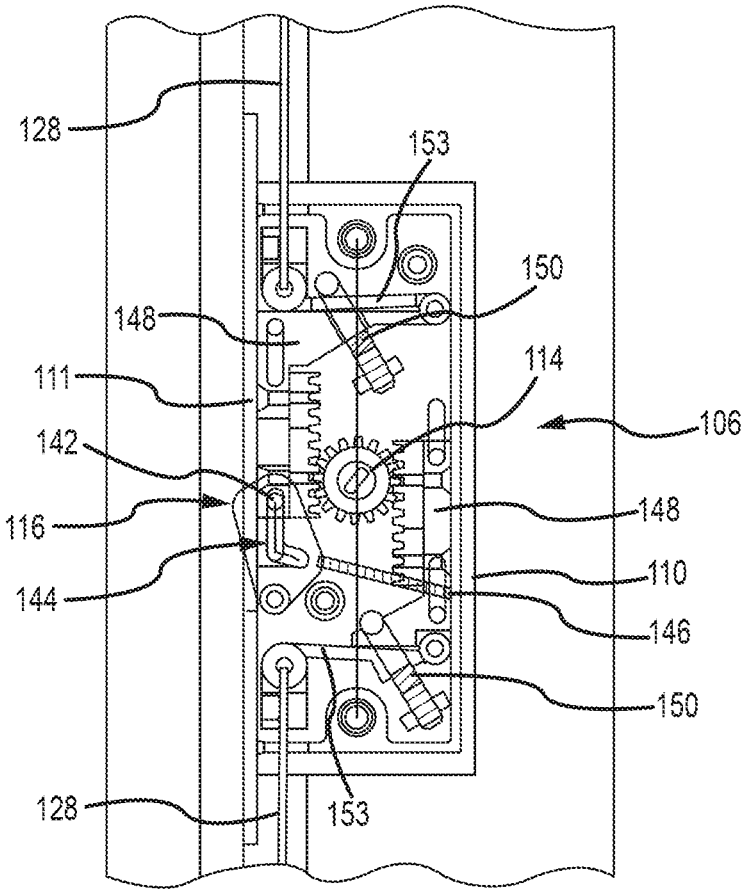
FIG. 2B depicts an enlarged side sectional view of the lock operator of FIG. 2, in an activated configuration.

FIG. 2B depicts an enlarged side sectional view of the lock operator of FIG. 2, in an activated configuration. In this configuration, the release trigger 116 has contacted the door frame F and is biased against the force of the compression spring 146 into the casing 110. This movement changes a position of the stop pin 142 relative to the slot 144, therefor allowing the rack 148 to move when the operating cam pinion 114 is rotated (e.g., by the turning of a handle or thumb turn). As can be seen, dual racks 148 are used, such that rotation of the operating cam pinion 114 moves both racks 148. As the racks 148 move, the linkages 153 move as well, which in turn moves the elongate members 128 towards the lock 108. This movement moves the release levers 126 therein, allowing the block 124 to engage the hooks 122. Rotation of the operating cam pinion 114 in the opposite direction disengages the block 124, which allows the door D to be pulled open. In examples, the elongate members 128 that may be substantially loose when the operator mechanism 112 is in the non-activated configuration depicted in FIGS. 2-2B.

Figure 3:
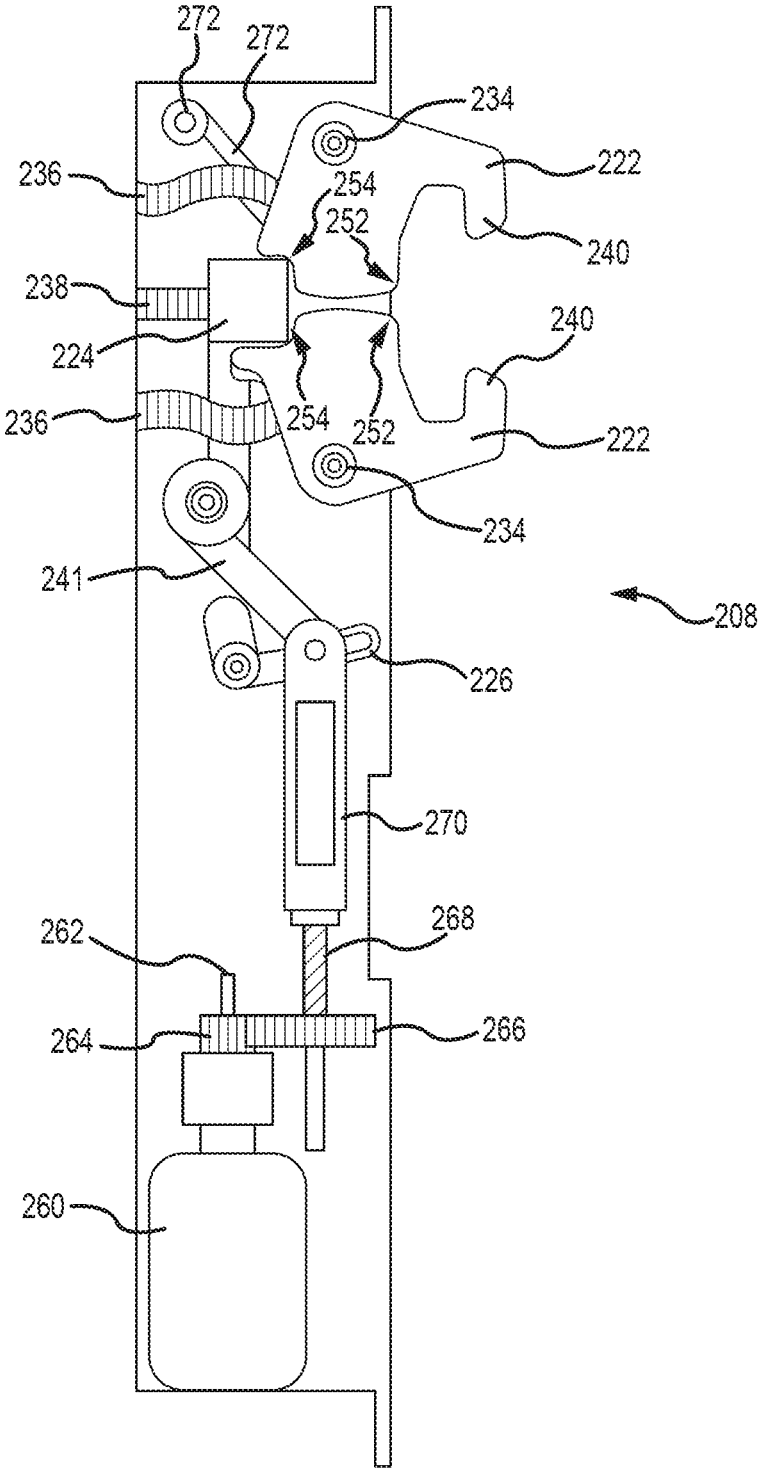
FIG. 3 depicts an enlarged side view of a lock in accordance with another example of the present technology.

FIG. 3 depicts an enlarged side view of a lock 208 in accordance with another example of the present technology. A number of components depicted in FIG. 3 are described above with regard to FIGS. 1, 1A, 2 and 2A, and as such, are not described further. Like components are similarly numbered. Unlike the locks depicted above, the lock 208 of FIG. 3 includes a motor 260 that is used to actuate the block 224 into and out of the engaged position depicted in FIG. 3. The motor 260 includes an output shaft 262 and output gear 264 that rotates therewith. The output gear 264 is engaged with a lead screw gear 266 that is connected to a lead screw 268. Rotation of the lead screw 268 advances and retracts an elongate nut 270 that is connected to either or both of the release lever 226 and the block lever 241 to engage or disengage the block 224. Otherwise, the lock 208 operates similarly to the non-motorized locks depicted elsewhere herein. That is, the hooks 222 are biased by springs 236, contact faces 252 of the hooks 222 contact the strike so as latch the hooks 222, and so on. The lock 208 may also include a manual release lever 272, which may be engaged with the block 224. In the event of a power failure, an actuator 272 connected to a thumb turn or other element disposed on a surface of the door may be turned so as to pivot the manual release lever 272. This pivoting disengages the block 224 from the hooks 222, thus allowing the door to be opened.

Figure 4:
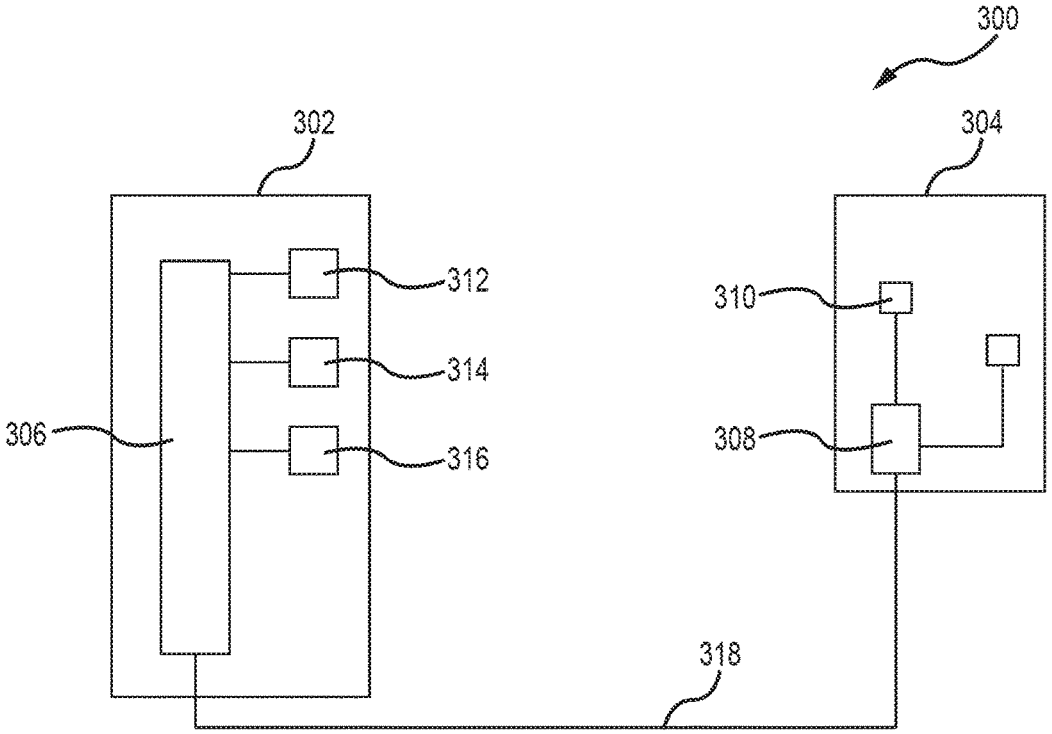
FIG. 4 depicts a schematic diagram of an electronic lock system in accordance with another example of the present technology.

FIG. 4 depicts a schematic diagram of an electronic lock system 300 in accordance with another example of the present technology. The lock system 300 includes a lock operator 302 and a remotely-disposed lock 304. In examples, the lock operator 302 may include a number of the same components as described with regard to the lock operators described elsewhere herein. However, the lock operator 302 includes additional sensors, actuators, and other components that enable control of the remotely-disposed lock 304. More specifically, the operator 302 may include a controller 306 that receives signals from the various other components and sends signals to the motor controller 308 associated with the motor 310. The motor 310 can engage and disengage the locking block as described above with regard to FIG. 3, for example. A number of sensors associated with the operator 302 are depicted. For example, a release trigger sensor 312 may detect a position of the release trigger and send a signal to the controller 306 when the release trigger is retracted into the housing (indicating engagement of the door and the frame, as described elsewhere herein). In certain examples, a signal from the release trigger sensor 312 may be a threshold requirement, allowing activation of the lock (e.g., actuation of the motor 310) only when an appropriate signal from the release trigger sensor 312 is received. Other sensors that depict positions or conditions of various components of the operator and lock are depicted. For example, a position sensor 314 may detect a position of a handle or thumb turn (or the operating cam pinion associated therewith). Upon receiving the appropriate signal, the controller 306 may send a signal to the motor controller 308 to activate the motor 310. An RFID sensor 316 may detect the presence of an RFID chip contained in a key used to actuate the operating cam pinion and send an appropriate signal. Sensor 316 may also be associated with a keyless entry system, such as the KEVO Bluetooth Electronic Lock available from Kwikset. Other types of sensors are contemplated. Signals are sent between the operator 302 and lock 304 via a wired or wireless connection 318. Additionally, powered components of the operator 302 and lock 304 may be powered by on board or remote batteries or by the building supply power.

In addition to the embodiments of the lock depicted herein, other embodiments having one or more locks actuated by a single lock operator are contemplated. For example, a single lock and a single lock operator may be used on a door. Alternatively, multiple locks and one or more lock operators can be utilized. It is contemplated that the various components and configurations depicted with regard to the locks disclosed herein, as well as modifications thereof envisioned by a person of ordinary skill in the art, are interchangeable.

The various elements of the locks depicted herein may be manufactured of any materials typically used in door hardware/lock manufacture. Such materials include, but are not limited to, cast or machined steel, stainless steel, brass, titanium, etc. Material selection may be based, in part, on the environment in which the lock is expected to operate, material compatibility, manufacturing costs, product costs, etc. Additionally, some elements of the lock may be manufactured from high-impact strength plastics. Such materials may be acceptable for applications where robust security is less critical, or when a secondary, stronger material is utilized in conjunction with the plastic part.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A sliding door lock system comprising:
a centrally-disposed operator comprising:
a casing;
a trigger retractably extending from the casing; and
an operator mechanism disposed in the casing and operatively engaged with the trigger, wherein the operator mechanism comprises:
at least one rack; and
a rotatable element engaged with the rack, wherein a rotation of the rotatable element moves the at least one rack between a first position and a second position;
a lock disposed remote from the operator, the lock comprising:
a housing;
a pair of opposed locking hooks extending from the housing; and
a spring biasing each of the pair of opposed locking hooks into an unlocked position; and
a block pivotably connected to the housing, wherein the block is configured to engage the pair of opposed locking hooks when the pair of opposed locking hooks are in a locked position; and
an elongate member operably connecting the operator mechanism to the block.

2. The sliding door lock system of claim 1, wherein the pair of opposed locking hooks each comprise a contact face configured to contact a strike so as to pivot each of the pair of opposed locking hooks into the locked position.

3. The sliding door lock system of claim 1, wherein the lock further comprises a block spring configured to bias the block into an engaged position where the block engages the pair of opposed locking hooks while in the locked position.

4. The sliding door lock system of claim 3, wherein the lock further comprises a release lever configured to oppose a force generated by the block spring, so as to hold the block in a disengaged position.

5. The sliding door lock system of claim 1, wherein the elongate member is a tension member configured to be substantially slack when the lock is in the locked position and configured to be substantially taut when the lock is in the unlocked position.

6. The sliding door lock system of claim 1, wherein the operator mechanism further comprises a take-up mechanism connecting the at least one rack to the elongate member.

7. The sliding door lock system of claim 6, wherein the take-up mechanism further comprises a spring-controlled linkage.

8. A lock system comprising:
a casing; and
an operator mechanism disposed in the casing, wherein the operator mechanism comprises:
at least one rack; and
a rotatable element engaged with the rack, wherein a rotation of the rotatable element moves the at least one rack between a first position and a second position;
a first housing disposed remote from the casing;
a lock mechanism disposed in the first housing; and
a pair of first opposing hooks extending from the first housing in both an unlocked position and a locked position, wherein each of the pair of first opposing hooks each comprise a contact face configured to engage a strike so as to pivot each of the pair of first opposing hooks from the unlocked position to the locked position.

9. The lock system of claim 8, further comprising a block configured to releasably engage a detent in each of the pair of first opposing hooks so as to secure the pair of first opposing hooks in the locked position.

10. The lock system of claim 9, wherein the block is movable based on an actuation of the operator mechanism.

11. The lock system of claim 10, further comprising a tension element, wherein the actuation of the operator mechanism transfers movement to the block via the tension element.

* * * * *